US011600947B2

(12) United States Patent
Kirschner et al.

(10) Patent No.: US 11,600,947 B2
(45) Date of Patent: Mar. 7, 2023

(54) ELECTRICAL CONNECTOR

(71) Applicant: MD ELEKTRONIK GmbH, Waldkraiburg (DE)

(72) Inventors: Thomas Kirschner, Muehldorf am Inn (DE); Johannes Eben, Rosenheim (DE); Matthias Plischke, Ampfing (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 17/352,387

(22) Filed: Jun. 21, 2021

(65) Prior Publication Data

US 2022/0006235 A1 Jan. 6, 2022

(30) Foreign Application Priority Data

Jul. 6, 2020 (DE) ..... 10 2020 117 717.8

(51) Int. Cl.

| | |
|---|---|
| ***H01R 13/627*** | (2006.01) |
| ***H01R 13/11*** | (2006.01) |
| ***H01R 13/629*** | (2006.01) |
| ***H01R 13/639*** | (2006.01) |

(52) U.S. Cl.

CPC ..... *H01R 13/6272* (2013.01); *H01R 13/11* (2013.01); *H01R 13/629* (2013.01); *H01R 13/639* (2013.01)

(58) Field of Classification Search

CPC .. H01R 13/6272; H01R 13/11; H01R 13/629; H01R 13/639; H01R 13/4223; H01R 13/4226; H01R 13/4362

See application file for complete search history.

(56) References Cited

U.S. PATENT DOCUMENTS

| | | | | | |
|---|---|---|---|---|---|
| 4,946,399 | A * | 8/1990 | Kawashima | H01R 13/436 | 29/842 |
| 5,004,436 | A * | 4/1991 | Aoyama | H01R 13/4368 | 439/752 |
| 5,044,972 | A * | 9/1991 | Ikeda | H01R 13/20 | 439/752 |
| 5,316,504 | A * | 5/1994 | Jinno | H01R 13/4223 | 439/752 |

(Continued)

FOREIGN PATENT DOCUMENTS

| | | | |
|---|---|---|---|
| DE | 102004005880 | A1 | 12/2004 |
| DE | 102004054572 | A1 | 6/2005 |

*Primary Examiner* — Thanh Tam T Le

(74) *Attorney, Agent, or Firm* — Leydig, Voit & Mayer, Ltd.

(57) ABSTRACT

An electrical connector for connection to a complementary mating connector includes a housing having at least one socket and at least one contact assembly which is disposed at least partially within the socket. A fastening element secures the contact assembly within the socket. A secondary retention means is movable between a pre-latched position and a final latched position, and, in the final latched position, prevents the fastening element from releasing securement of the contact assembly in the socket. The housing has a fastening groove extending along the socket at least along a portion of its length for securing the secondary retention means. In the final latched position, the secondary retention means engages by at least one latching element in the fastening groove.

14 Claims, 3 Drawing Sheets

(56) References Cited

U.S. PATENT DOCUMENTS

| | | | | | |
|---|---|---|---|---|---|
| 5,378,176 | A * | 1/1995 | Sasai | H01R 13/4362 | 439/752 |
| 5,460,550 | A * | 10/1995 | Okayasu | H01R 13/4362 | 439/752 |
| 5,501,620 | A * | 3/1996 | Ishii | H01R 13/4368 | 439/752 |
| 5,651,703 | A * | 7/1997 | Sasai | H01R 13/4362 | 439/752 |
| 5,730,627 | A | 3/1998 | Okabe | | |
| 5,769,670 | A * | 6/1998 | Abe | H01R 13/4362 | 439/752 |
| 6,354,873 | B1 * | 3/2002 | Morello | H01R 13/4362 | 439/352 |
| 6,497,591 | B2 * | 12/2002 | Fujita | H01R 13/4362 | 439/752 |
| 6,971,924 | B2 * | 12/2005 | Fujita | H01R 13/516 | 439/701 |
| 7,014,512 | B2 * | 3/2006 | Mase | H01R 13/4361 | 439/752 |
| 7,175,483 | B2 * | 2/2007 | Ishikawa | H01R 13/4362 | 439/752 |
| 10,348,020 | B2 * | 7/2019 | Zhu | H01R 12/716 | |
| 10,566,725 | B2 * | 2/2020 | Ochiai | H01R 13/426 | |
| 11,205,868 | B2 * | 12/2021 | Domergue | H01R 13/506 | |
| 11,217,943 | B2 * | 1/2022 | Maesoba | H01R 13/111 | |

* cited by examiner

ELECTRICAL CONNECTOR

CROSS-REFERENCE TO PRIOR APPLICATION

Priority is claimed to German Patent Application No. DE 10 2020 117 717.8, filed on Jul. 6, 2020, the entire disclosure of which is hereby incorporated by reference herein.

FIELD

The invention relates to an electrical connector for connection to a complementary mating connector.

BACKGROUND

Electrical cables are typically connected together or to an electrical device using electrical connectors which can be releasably connected to a complementary mating connector, thereby creating an electrically conductive connection. In such a connection, the cable is connected to the connector, whereas the mating connector is electrically conductively connected to the partner to be connected, so that when the connector and the mating connector are connected together, an electrically conductive connection is created between the cable and the respective partner to be connected.

In particular, in the case of connectors where it must be ensured that the connection between the cable and the connector and/or the connection between the connector and the mating connector are/is properly made, additional retention systems are frequently used. For example, a secondary locking means may be provided which is capable of additionally securing the cable on or in the connector. The connector may further have an insertion-preventing means which prevents the connector and the mating connector from being connected when the cable is not properly connected to the connector and/or the partner to be connected is not properly connected to the mating connector. Furthermore, depending on the available space, it may be necessary to connect a plurality of cables via one connector to a corresponding complementary mating connector.

However, both the additional retention systems and the requirement of being able to connect a plurality of cables using one connector significantly increase the complexity of the connector. Especially in the case of small connectors such as are used, for example, for radio-frequency cables, the wide range of functions increases the manufacturing complexity and cost of the connector.

SUMMARY

In an embodiment, the present disclosure provides an electrical connector for connection to a complementary mating connector. The electrical connector includes a housing having at least one socket and at least one contact assembly which is disposed at least partially within the socket. A fastening element secures the contact assembly within the socket. A secondary retention means is movable between a pre-latched position and a final latched position, and, in the final latched position, prevents the fastening element from releasing securement of the contact assembly in the socket. The housing has a fastening groove extending along the socket at least along a portion of its length for securing the secondary retention means. In the final latched position, the secondary retention means engages by at least one latching element in the fastening groove

BRIEF DESCRIPTION OF THE DRAWINGS

Embodiments of the present invention will be described in even greater detail below based on the exemplary figures.

The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1:
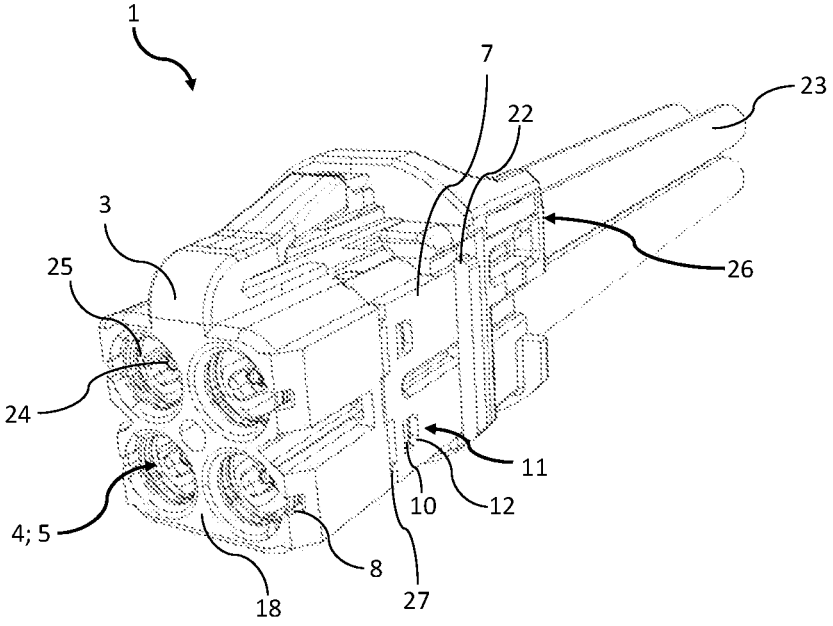
FIG. 1 is a three-dimensional view of a first embodiment of a connector according to the invention.

In an embodiment, the present invention provides an electrical connector which overcomes at least one of the disadvantages of the above-mentioned prior art and which exhibits a lower degree of complexity, while providing the same functionality.

An electrical connector according to an embodiment of the invention for, in particular, mechanical and electrical connection to a complementary mating connector has at least one housing. The housing includes at least one socket. However, the housing may also have a plurality of sockets, preferably two sockets, and more preferably four sockets. The socket is preferably cylindrical in shape. The connector further has at least one contact assembly disposed at least partially within the socket. The socket is preferably accessible from outside the housing at least two points which are particularly preferably opposite each other, so that the contact assembly can be inserted into the socket at one point, and an electrically conductive connection to the mating connector can be created via the second point. The contact assembly may be made up of one or more conductive elements which are in electrically conductive connection with a cable. If the cable is a coaxial cable, the contact assembly may include, for example, an inner conductor contact connected to the inner conductor of the cable and an outer conductor contact connected to the outer conductor of the cable. If the housing has a plurality of sockets, one contact assembly may be provided for each of the sockets.

The electrical connector further includes a fastening element by which the contact assembly, which is disposed at least partially within the socket secures, is secured in the socket. If the housing has a plurality of sockets for a plurality of contact assemblies, one fastening element may be provided for each of the sockets. The fastening element secures the contact assembly preferably releasably within the socket, for example, by an interlocking fit and/or a friction fit. The fastening element may, for example, have a latching nose that engages with a complementary contour in the contact assembly. In order to provide the fastening element in a particularly efficient way, it is advantageous to form the fastening element and the housing as a single piece.

The electrical connector includes a secondary retention means that is movable between a pre-latched position and a final latched position. Preferably, the secondary retention means is connected to the housing both in the pre-latched position and in the final latched position. In the pre-latched position, the secondary retention means may serve as an insertion-preventing means, so that the electrical connector cannot be connected to the mating connector when the secondary retention means is in the pre-latched position. In the final latched position, the secondary retention means prevents the fastening element from releasing the securement of the contact assembly in the socket. This can be achieved, for example, by the secondary retention means at least limiting, or more preferably impeding, the movability of the fastening element in the final latched position. Thus, in the final latched position, the secondary retention means prevents the securement of the contact assembly within the socket from being released by the fastening element. If this securement is intended to be released, the secondary retention means must first be moved from the final latched position back to the pre-latched position.

The housing has a fastening groove extending along the socket at least along a portion of its length. The fastening groove is preferably open toward the socket and preferably has a polygonal, in particular square, cross-sectional geometry. If the housing has a plurality of sockets, a plurality of fastening grooves may also be provided. Preferably, each socket has one fastening groove associated therewith. If a plurality of fastening grooves are provided, the fastening grooves are particularly preferably disposed parallel to each other. Furthermore, the fastening groove preferably extends parallel to a direction of longitudinal extension of the socket. The secondary retention means has at least one latching element which, in the final latched position, engages in the fastening groove. It is preferred here that the latching element interlockingly connect the secondary retention means to the housing, and that the secondary retention means be held in the final latched position by the latching element. It is preferred here that in the final latched position, the latching element remain outside of the socket; in other words, that it extend only into the fastening groove, but not into the socket.

The design according to an embodiment of the invention makes it possible to provide a connector that can be manufactured in particular by injection molding with significantly less manufacturing complexity and cost. Because the housing has a fastening groove that is open toward the socket and also serves to interlockingly connect the secondary retention means at least in the final latched position, it is possible to choose a significantly simpler geometry for the injection mold to be able to manufacture the electrical connector according to an embodiment of the invention, since there is no need for complex slide systems for forming the socket and further possible fastening features for the secondary retention means.

The fastening element may have a latching arm which is elastically deformable, for example, to create the securement of the contact assembly within the socket. The latching arm preferably has a main direction of extension that is parallel to a direction of longitudinal extension of the socket. It is further preferred that a latching nose be disposed on a side facing the socket, the latching nose extending at least partially into the socket and engaging at least partially in a recess in the contact assembly.

Pluggable connections may be subject to high mechanical loads both during and after assembly. As a result of such loads, the securement of the contact assembly by the fastening element may also be subject to very high loads. It may therefore be advantageous if the fastening element has a supporting element on a side facing away from the socket, and particularly preferably on a side facing the secondary retention means, which supporting element is at least partially disposed in an aperture of the secondary retention means, at least in the final latched position. If the housing has a plurality of sockets which each have a fastening element, it may be advantageous if each fastening element has a supporting element. It is particularly preferred here that in this case, the secondary retention means have a plurality of apertures so that a plurality of supporting elements can each engage in a respective one of the apertures of a secondary retention means. To facilitate assembly and disassembly, it may also be advantageous if in the pre-latched position, the supporting element is located outside of the aperture. The supporting element may be formed, for example, as a projection projecting from the fastening element. If the fastening element has a latching arm and a latching nose, it is particularly advantageous if the supporting element is disposed opposite the latching nose on the latching arm.

The supporting element may abut against at least one side surface of the aperture of the secondary retention means, at least in the final latched position. It is particularly advantageous here if the supporting element abuts against a side surface that extends parallel to a short side of the latching arm. In order to ensure that the supporting element abuts against the side surface of the aperture after the secondary retention means has been moved from the pre-latched position to the final latched position, the secondary retention means and/or the housing may have positioning elements, such as crush ribs, which ensure that the side surface makes contact with the supporting element. By the side surface making contact with the supporting element, forces acting on the fastening element can be more effectively transferred to the secondary retention means.

The housing may have a cutout in a side wall. The cutout adjoins the socket such that the socket is accessible via the cutout. Preferably, the fastening groove is also accessible via the cutout. The fastening element may also be at least partially disposed within the cutout. If the housing has a plurality of sockets, it is also possible that a plurality of sockets are accessible via the cutout and/or that a plurality of fastening elements are disposed at least partially within the cutout.

Preferably, the fastening groove extends from a plug end of the housing to the cutout. In this context, the plug end of the housing may be understood to be the end of the housing where the housing is connectable to a complementary mating connector. It is further preferred that the fastening groove be open toward the plug end and toward the cutout.

The socket may have at least one end stop at the plug end. The end stop may serve as a stop for the contact assembly so that the contact assembly cannot be passed through the socket beyond the plug end. The end stop may be implemented, for example, by a reduction in diameter. In this case, the diameter in the end stop is smaller than the outer diameter of the contact assembly. The end stop may have a gap in the region of the fastening groove so that, in spite of the end stop, the fastening groove is still open at the plug end. The fastening groove is preferably disposed in a region of the socket that faces the side wall of the housing in which the cutout is formed.

The secondary retention means may be at least partially disposed within the cutout, at least in the final latched position. The latching element, which, at least in the final latched position, engages in the fastening groove may extend at least partially through the cutout in the final latched position so that the latching element engages in the fastening groove through the cutout.

The secondary retention means may have at least one locking element which, in the final latched position, extends into the socket and secures the contact assembly in the socket. Thus, due to the locking element, the contact assembly is secured in the socket not only by the fastening element, but also be the secondary retention means. If the housing has a plurality of sockets, the secondary retention means may have a plurality of locking elements, so that a plurality of contact assemblies in different sockets may also be additionally secured by a secondary retention means.

To be able to ensure that the secondary retention means can be moved from the final latched position back to the pre-latched position, the secondary retention means may have a release aid. The release aid may be configured, for example, in the form of a slot so that the secondary retention means may be moved, for example, by insertion of a disassembly aid into the slot. Alternatively, the release aid may be configured, for example, as a projection that creates an alignment between the housing and the secondary retention means. A disassembly tool can then be positioned within the alignment, and the secondary retention means can be levered back to the pre-latched position.

If the housing has at least two sockets, it is preferred that for each socket, the housing have a fastening groove that is open toward the socket. At least in the final latched position, the secondary retention means may engage by one respective latching element in one respective fastening groove, so that the secondary retention means engages by the latching elements in both fastening grooves.

FIG. 1 shows a first embodiment of a connector 1 according to the invention in a three-dimensional view. The inventive connector 1 is suitable for being releasably electrically and mechanically connected to a complementary mating connector. Connector 1 possesses a housing 3 having four sockets 4. In the present exemplary embodiment, sockets 4 are disposed parallel to each other and formed cylindrical in shape. Sockets 4 are arranged relative to one another such that their central axes are each located at a respective corner of an imaginary square. Each socket 4 has a contact assembly 5 disposed therein. Each contact assembly 5 is electrically conductively connected to a cable 23. In the present exemplary embodiment, cables 23 are coaxial cables having an inner conductor and an outer conductor. Accordingly, in the present exemplary embodiment, contact assembly 5 has an inner conductor contact 24 electrically conductively connected to the inner conductor of cable 23, and an outer conductor contact 25 electrically conductively connected to the outer conductor of cable 23. Contact assemblies 5 are inserted into sockets 4 at a rear end 26. Connector 1 is connectable by a plug end 18 to a mating connector.

Figure 2:
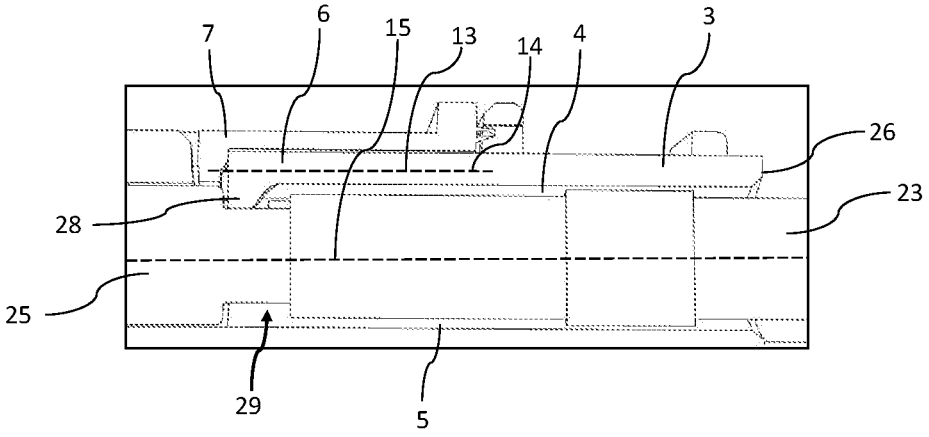
FIG. 2 is a sectional view of the first embodiment in the region of a socket of the connector.

FIG. 2 shows an enlarged sectional view of a socket 4 according to the first embodiment of the inventive connector 1. In order to secure contact assembly 5 in socket 4, connector 1 has a fastening element 6 which, in the present embodiment, is formed integrally with and of the same material as housing 3. In the present exemplary embodiment, fastening element 6 is formed by a latching arm 13 having a latching nose 28 at its free end. The main direction of extension 14 of latching arm 13 is parallel to the direction of longitudinal extension 15 of socket 4. Latching nose 28 extends partially into socket 4 and engages in a recess 29 extending circumferentially around contact assembly 5. Contact assembly 5 is secured within socket 4 by fastening element 6. In the present example, housing 3 and fastening element 6 are made of plastic, so that contact assembly 5 is positionable within socket 4 by the elasticity of fastening element 6 alone, namely by latching arm 13 flexing away from socket 4 during insertion of contact assembly 5.

To prevent self-release of the securement of contact assembly 5 within socket 4 by fastening element 6, the connector according to an embodiment of the invention has a secondary retention means 7 that is movable between a pre-latched position and a final latched position. In the final latched position, secondary retention means 7 prevents fastening element 6 from releasing the securement of contact assembly 5. In FIG. 2, secondary retention means 7 is disposed in the final latched position. In the present exemplary embodiment, in the final latched position, secondary retention means 7 is disposed on a side of fastening element 6 facing away from socket 4 and rests against latching arm 13. The secondary retention means thus blocks movement of fastening element 6 away from socket 4. Therefore, in the final latched position of the secondary retention means, latching nose 28 cannot be moved out of recess 29. To this end, secondary retention means 7 is interlockingly connected to housing 3 in the final latched position.

Figure 3:
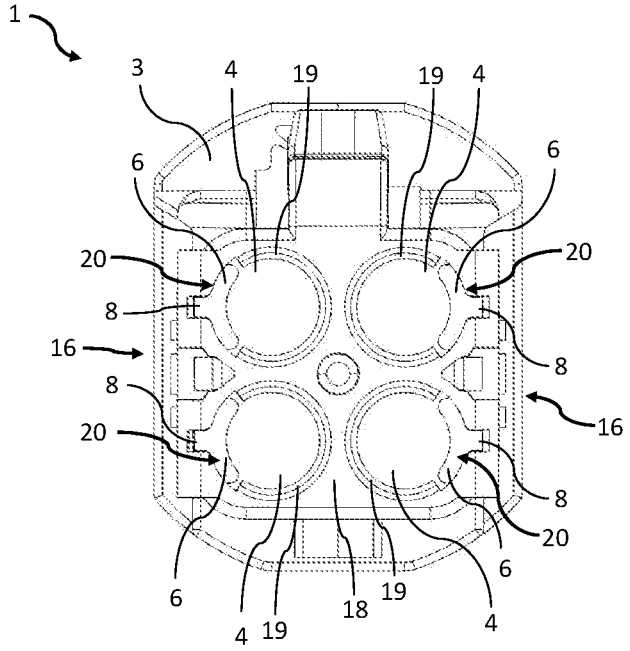
FIG. 3 is a view of a second embodiment of the connector according to the invention.

FIG. 3 shows a second embodiment of the connector 1 according to the invention, with plug end 18 facing the viewer. In the present exemplary embodiment, housing 3 has four sockets 4 extending parallel to one another. Each socket 4 has a respective fastening groove 8 formed therein which is open toward the respective socket 4. Fastening grooves 8 extend parallel to socket 4 and have a square cross-sectional shape. Furthermore, all four fastening grooves 8 have the same cross-sectional shape. Fastening grooves 8 are disposed such that the fastening grooves 8 of two sockets 4 extend parallel to each other in the direction of the same side wall 16. Moreover, each socket 4 has an end stop 19 at a plug-end end. Each end stop 19 prevents a contact assembly inserted into the respective socket 4 from being moved beyond plug end 18. In the present exemplary embodiment, end stop 19 is implemented by a reduction in diameter. Each end stop 19 has a gap 20 in the region of fastening groove 8.

Figure 4:
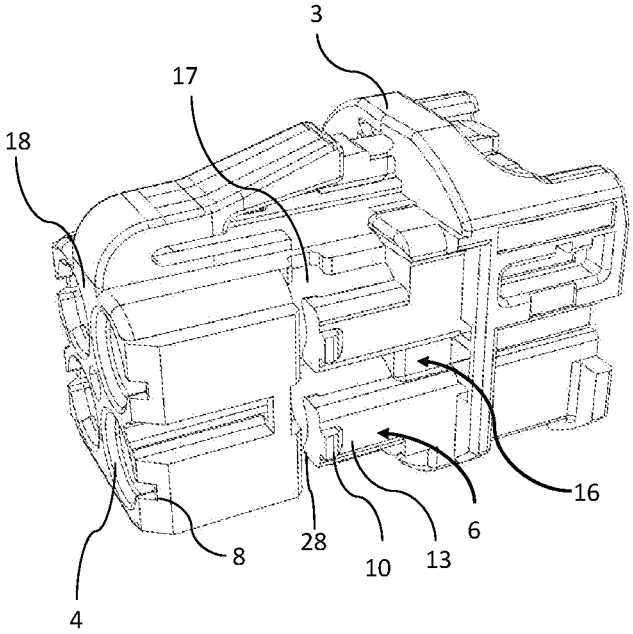
FIG. 4 is a three-dimensional view of the second embodiment of the connector according to the invention.

FIG. 4 shows the second embodiment of FIG. 3 in a three-dimensional view. Housing 3 has a cutout 17 in side wall 16. In the region of cutout 17, two of the four sockets 4 are open, so that two sockets 4 are laterally accessible via cutout 17. Fastening grooves 8 of sockets 4 extend from plug end 18 to cutout 17, the fastening grooves 8 being open and accessible both at plug end 18 and at cutout 17. In the present exemplary embodiment, two fastening elements 6 are disposed within cutout 17, each fastening element 6 being associated with one socket 4. In the present exemplary embodiment, fastening elements 6 have a latching arm 13 and a latching nose 28, the latching nose 28 extending into the respective socket 4. In addition, each fastening element 6 has a supporting element 10. Fastening elements 6 are formed integrally with and of the same material as housing 3. On a side facing away from the viewer, housing 3 has an identical cutout 17, the arrangement of fastening elements 6 also being identical.

Figure 5:
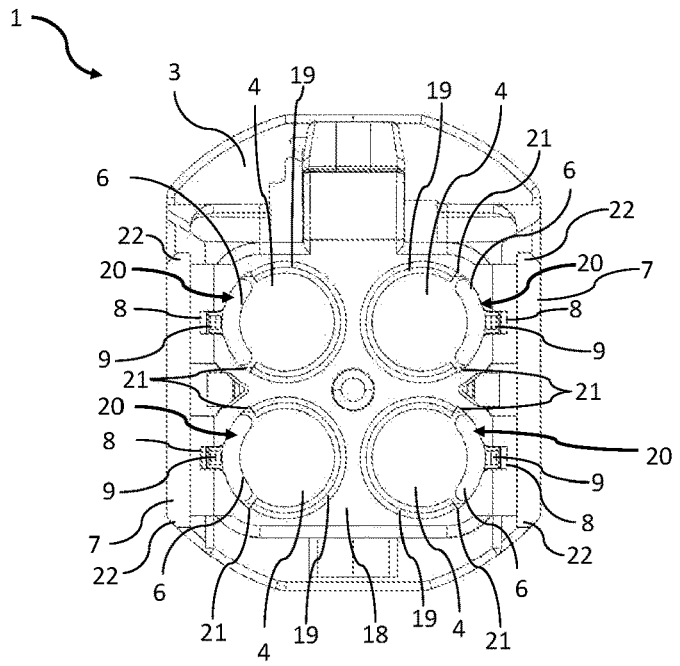
FIG. 5 is a view showing the second embodiment of the inventive connector with a secondary retention means.

FIG. 5 shows the second embodiment of the inventive connector 1 with two secondary retention means 7 disposed on housing 3. Plug end 18 faces the viewer. Secondary retention means 7 is in the final latched position. Each of the two secondary retention means 7 has two latching elements 9 which, in the final latched position, engage in fastening grooves 8, thus interlockingly connecting secondary retention means 7 to housing 3 in the final latched position. In the present exemplary embodiment, latching elements 9 are positioned in fastening grooves 8 through the cutout. The latching elements 9 of a respective secondary retention means 7 engage in the fastening grooves 8 that extent toward the same side wall 16 of the housing. In the present exemplary embodiment, secondary retention means 7 is made of plastic. Both secondary retention means 7 further have two locking elements 21 for each socket 4, which, in the final latched position, extend into the respective socket 4 and serve to additionally secure a contact assembly in socket 4. In order to facilitate movement of secondary retention means 7 from the final latched position back to a pre-latched position, secondary retention means 7 have release aids 22. In the present exemplary embodiment, the release aids are implemented as projections. If it is desired to move secondary retention means 7 from the final latched position back to the pre-latched position, secondary retention means 7 can be moved with a disassembly tool using the lever principle. In the present exemplary embodiment, the disassembly tool may be, for example, a screwdriver.

Figure 6:
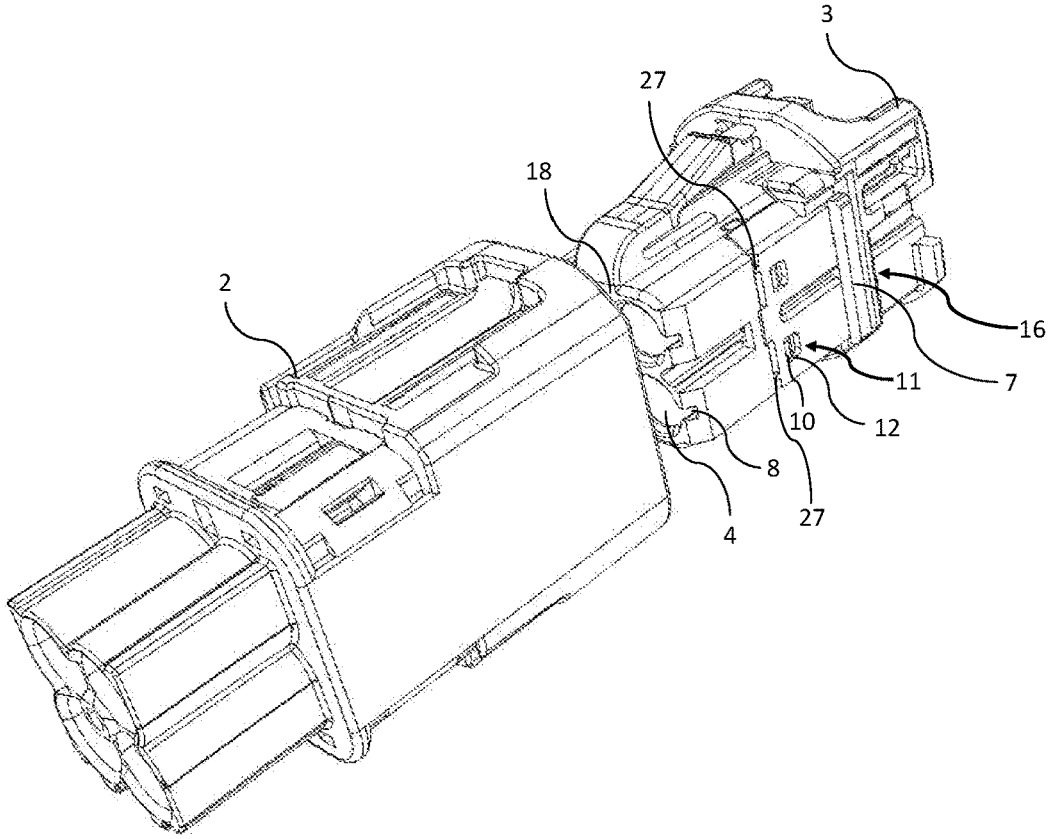
FIG. 6 is a three-dimensional view showing the second embodiment of the inventive connector with a mating connector.

FIG. 6 shows, in a three-dimensional view, the second embodiment of the inventive connector 1 with secondary retention means 7 and a mating connector 2. Secondary retention means 7 are disposed in the final latched position. The secondary retention means 7 facing the viewer has two apertures 11 into each of which extends a supporting element 10 of a fastening element 6. The supporting element 10 disposed in aperture 11 rests against a side surface 12 of aperture 11. In order to ensure that supporting element 10 makes proper contact with side surface 12 when secondary retention means 7 is moved to the final latched position, secondary retention means 7 has two crush ribs 27. By means of crush ribs 27, the side surface 12 of the aperture is pressed against the supporting element 10 of the fastening element. The second secondary retention means 7, which in the present view faces away from the viewer, is identical in construction. In the present exemplary embodiment, in the pre-latched position, secondary retention means 7 additionally have the function of an insertion-preventing means, which is implemented by secondary retention means 7 sticking out from housing 3 in the pre-latched position. Due to this sticking out, connector 1 no longer fits into mating connector 2, which prevents insertion.

The explanations provided with regard to the figures are merely for the sake of illustration and are not to be construed as limiting.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 connector
2 mating connector
3 housing
4 socket
5 contact assembly
6 fastening element
7 secondary retention means
8 fastening groove
9 latching element
10 supporting element
11 aperture
12 side surface (aperture)
13 latching arm
14 main direction of extension
15 direction of longitudinal extension
16 side wall (housing)
17 cutout
18 plug end
19 end stop
20 gap
21 locking element
22 release aid
23 cable
24 inner conductor contact
25 outer conductor contact
26 rear end
27 crush ribs
28 latching nose
29 recess

What is claimed is:

1. An electrical connector for connection to a complementary mating connector, the electrical connector comprising:

a housing having at least one socket;

at least one contact assembly which is disposed at least partially within the socket;

a fastening element which secures the contact assembly within the socket;

a secondary retention means which is movable between a pre-latched position and a final latched position, and which, in the final latched position, prevents the fastening element from releasing securement of the contact assembly in the socket;

wherein the housing has a fastening groove extending along the socket at least along a portion of a length for securing the secondary retention means, wherein, in the final latched position, the secondary retention means engages by at least one latching element in the fastening groove, wherein the fastening element has a latching arm having a main direction of extension that is parallel to a direction of longitudinal extension of the socket, and wherein the fastening element has a supporting element on a side facing away from the socket, and wherein the supporting element is at least partially disposed in an aperture of the secondary retention means, at least in the final latched position.

2. The electrical connector as recited in claim 1, wherein the supporting element abuts against at least one side surface of the aperture.

3. The electrical connector as recited in claim 1, wherein the housing has a cutout in a side wall, wherein the socket is accessible via the cutout, and wherein the fastening element is at least partially disposed within the cutout.

4. The electrical connector as recited in claim 3, wherein the fastening groove extends from a plug end of the housing to the cutout.

5. The electrical connector as recited in claim 4, wherein the socket has at least one end stop at the plug end, and wherein the end stop has a gap at least in the region of the fastening groove.

6. The electrical connector as recited in claim 4, wherein the fastening groove is disposed in a region of the socket facing the side wall.

7. The electrical connector as recited in claim 4, wherein the secondary retention means is at least partially disposed within the cutout, at least in the final latched position, and the latching element extends at least partially through the cutout.

8. The electrical connector as recited in claim 1, wherein the secondary retention means has at least one locking element which, at least in the final latched position, extends into the socket and additionally secures the contact assembly in the socket.

9. The electrical connector as recited in claim 1, wherein the secondary retention means has at least one release aid by which the secondary retention means is movable from the final latched position to the pre-latched position.

10. The electrical connector as recited in claim 1, wherein the housing has at least two sockets, each of the sockets having at least one fastening groove, and wherein, at least in the final latched position, the secondary retention means engages by a respective latching element in a respective fastening groove.

11. An electrical connector for connection to a complementary mating connector, the electrical connector comprising:

a housing having at least one socket;

at least one contact assembly which is disposed at least partially within the socket;

a fastening element which secures the contact assembly within the socket;

a secondary retention means which is movable between a pre-latched position and a final latched position, and which, in the final latched position, prevents the fastening element from releasing securement of the contact assembly in the socket;

wherein the housing has a fastening groove extending along the socket at least along a portion of a length for securing the secondary retention means, wherein, in the final latched position, the secondary retention means engages by at least one latching element in the fastening groove, and wherein the housing has at least two sockets, each of the sockets having at least one fastening groove, and wherein, at least in the final latched position, the secondary retention means engages by a respective latching element in a respective fastening groove.

12. An electrical connector for connection to a complementary mating connector, the electrical connector comprising:

a housing having at least one socket;

at least one contact assembly which is disposed at least partially within the socket;

a fastening element which secures the contact assembly within the socket;

a secondary retention means which is movable between a pre-latched position and a final latched position, and which, in the final latched position, prevents the fastening element from releasing securement of the contact assembly in the socket;

wherein the housing has a fastening groove extending along the socket at least along a portion of a length for securing the secondary retention means, wherein, in the final latched position, the secondary retention means engages by at least one latching element in the fastening groove, wherein the housing has a cutout in a side wall, wherein the socket is accessible via the cutout, and wherein the fastening element is at least partially disposed within the cutout, wherein the fastening groove extends from a plug end of the housing to the cutout, and wherein at least one of:

the socket has at least one end stop at the plug end, and the end stop has a gap at least in the region of the fastening groove, or the secondary retention means is at least partially disposed within the cutout, at least in the final latched position, and the latching element extends at least partially through the cutout.

13. The electrical connector as recited in claim 12, wherein the socket has the at least one end stop at the plug end, and wherein the end stop has the gap at least in the region of the fastening groove.

14. The electrical connector as recited in claim 12, wherein the secondary retention means is at least partially disposed within the cutout, at least in the final latched position, and the latching element extends at least partially through the cutout.

* * * * *